United States Patent [19]

Crossley

[11] 4,239,229

[45] Dec. 16, 1980

[54] GAME BOARD APPARATUS

[76] Inventor: Rolland S. Crossley, 4617 Forest, Kansas City, Mo. 64110

[21] Appl. No.: 927,762

[22] Filed: Jul. 25, 1978

Related U.S. Application Data

[63] Continuation-in-part of Ser. No. 781,412, Mar. 25, 1977, abandoned.

[51] Int. Cl.[3] ..... A63F 3/00

[52] U.S. Cl. ..... 273/255; 273/262; 273/256

[58] Field of Search ..... 273/256, 255, 254, 280, 273/262

[56] References Cited

U.S. PATENT DOCUMENTS

| | | | |
|---|---|---|---|
| 2,757,933 | 8/1956 | Gilmour | 273/254 |
| 3,058,747 | 10/1962 | Nemetsky | 273/256 |
| 3,865,381 | 2/1975 | Hayes | 273/256 |
| 4,010,954 | 3/1977 | Uding | 273/253 X |

OTHER PUBLICATIONS

"Summit" *Bookworld,* Dec. 19, 1971, p. 3.

*Primary Examiner*—Richard C. Pinkham
*Assistant Examiner*—Scott L. Brown
*Attorney, Agent, or Firm*—Fishburn, Gold and Litman

[57] ABSTRACT

A board game apparatus comprises a game board having a playing area divided into a plurality of cartels. Contest tokens are movable about the playing area between adjacent cartels for occupying a cartel, challenging opposing players to the right to occupy a cartel, and for defending such a challenge. A resource calculator designates at least two resources, generates a production and a consumption index for each resource, and provides instructions for exchanging surplus resources. A common market place is provided for exchanging a quantity of one resource for a quantity of another resource. A chance apparatus determines the right to occupy a cartel challenged by a player, whereby in playing the game, each player receives resource tokens in accordance with the assigned production index for each cartel which the player occupies, and must balance production and consumption of each of his resources. Players may withhold selected resources from the market place, and/or exchange surplus resource tokens for contest tokens and challenge opposing players for the right to occupy a cartel, so as to ultimately obtain simultaneous occupation of a preselected, game-ending number of the cartels.

12 Claims, 7 Drawing Figures

GAME BOARD APPARATUS

CROSS REFERENCE TO RELATED APPLICATION

This application is a continuation-in-part of United States patent application Ser. No. 781,412, filed Mar. 25, 1977 now abandoned.

BACKGROUND OF THE INVENTION

This invention relates to board game devices, and in particular to a game construction simulating international economic and political interaction.

SUMMARY OF THE INVENTION

The principal objects of the present invention are: to provide an educational and entertaining game for two or more players; to provide a game having a game board divided into a plurality of separate regions designating different cartels; to provide such a game wherein each of the players seeks to simultaneously occupy a predetermined, game-ending number of cartels; to provide such a game having a resource calculator designating at least two resources, generating a production and consumption index for each resource, and providing means for exchanging surplus resources; to provide such a game which develops competitive strategy, and an understanding of international economics and politics; to provide such a game wherein strategy encompasses geographic location, interdependent economics, and military conflict; to provide such a game wherein each cartel is separated by a corridor through which contest tokens of each of the players is movable to challenge the right of opposing players to occupy a cartel; to provide such a game wherein a dominant occupation of each corridor surrounding a cartel forms a military embargo and prevents the surrounded cartel from exchanging resource tokens at the common market place; to provide such a game having a plurality of cards designating a particular disaster and consequence to present to an in-turn player by an opposing player to reduce the production index of selected resources; to provide such a game including a plurality of cards designating a path for moving contest tokens between non-adjacently disposed cartels for use by an in-turn player to challenge an opposing player; and to provide such a game which is economical to manufacture, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification, and include exemplary embodiments of the present invention and illustrate various objects and features thereof.

DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
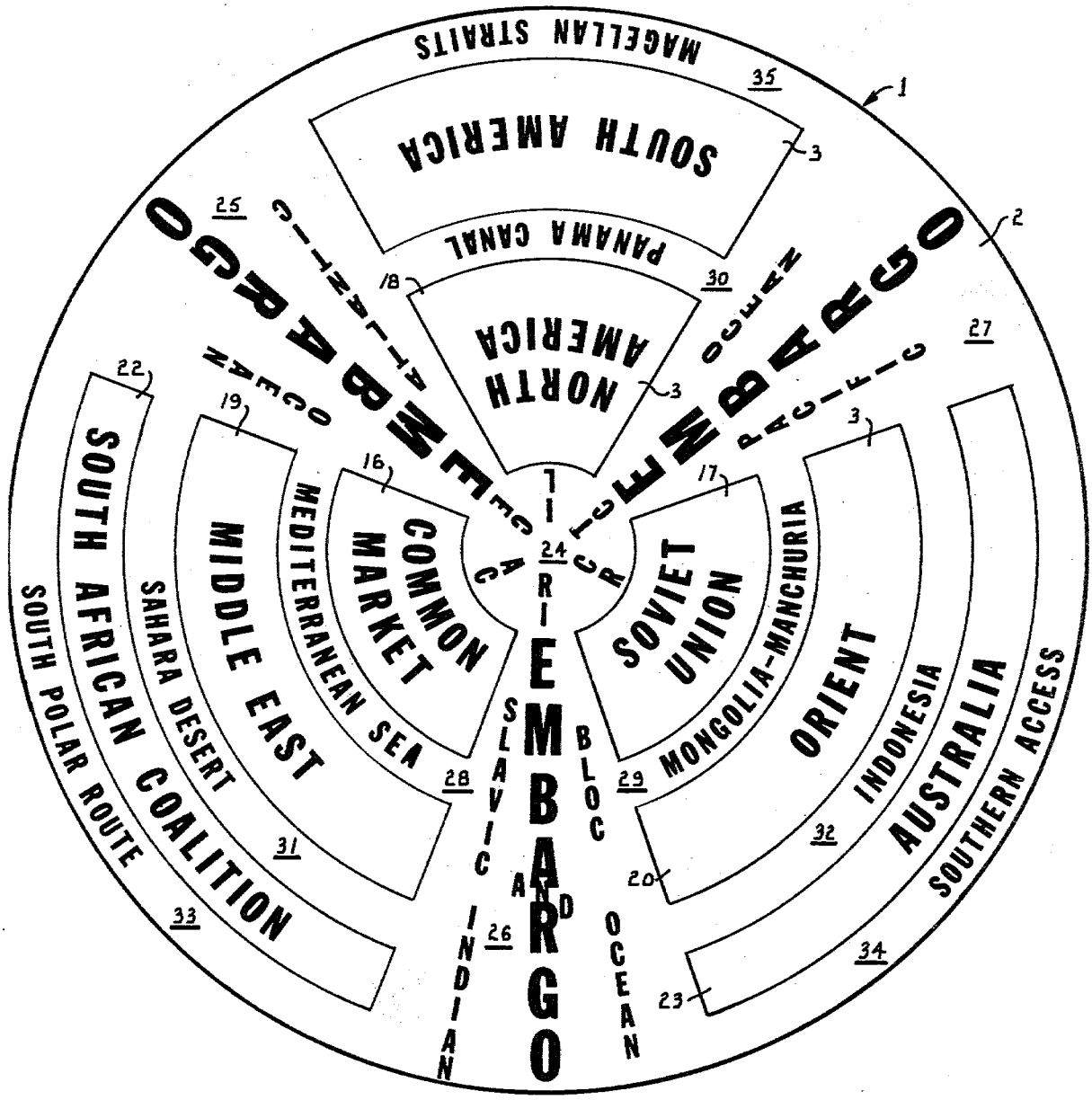
FIG. 1 is a top plan view of a game board used in the present invention.
Figure 4:
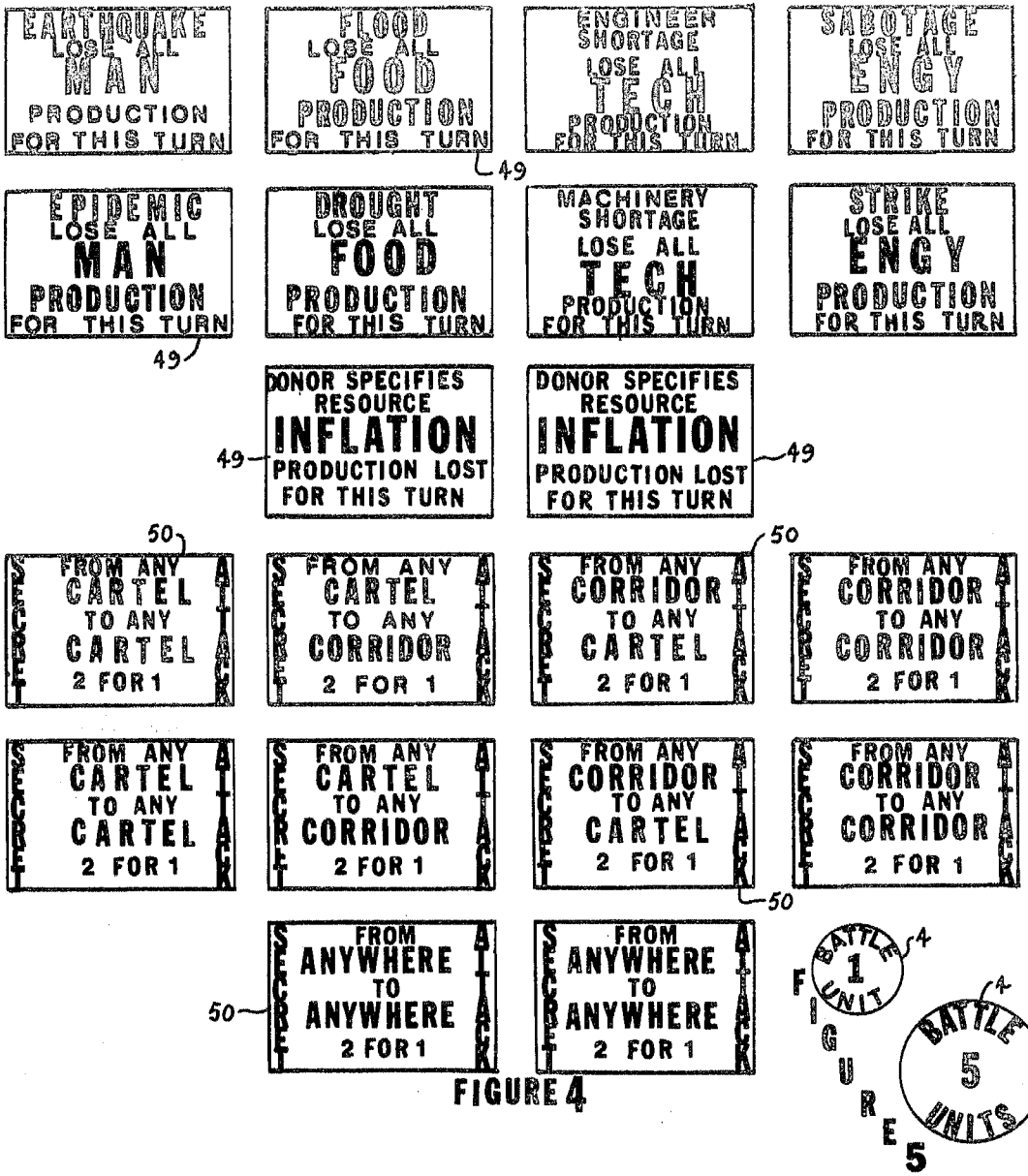
FIG. 4 is a plan view of a plurality of playing cards including indicia thereon for instruction and/or permitting the game players to perform certain moves.

For purposes of description herein, the terms "upper", "lower", "right", "left", "rear", "front", "vertical", "horizontal", and derivitives thereof shall relate to the invention as oriented in FIG. 1, however, it is to be understood that the invention may assume various alternative orientations, except where expressly specified to the contrary.

Figure 3:
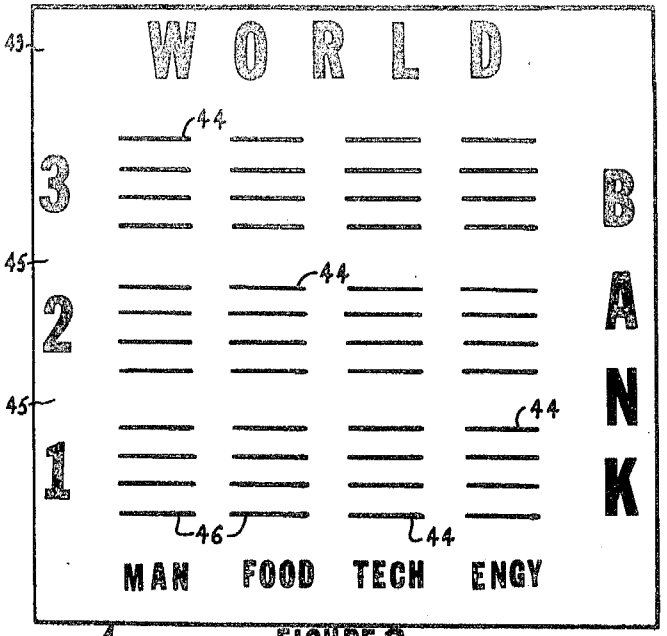
FIG. 3 is a plan view of a container for the resource tokens, which forms a common market place for exchanging a quantity of one resource for a quantity of another resource.
Figure 2:
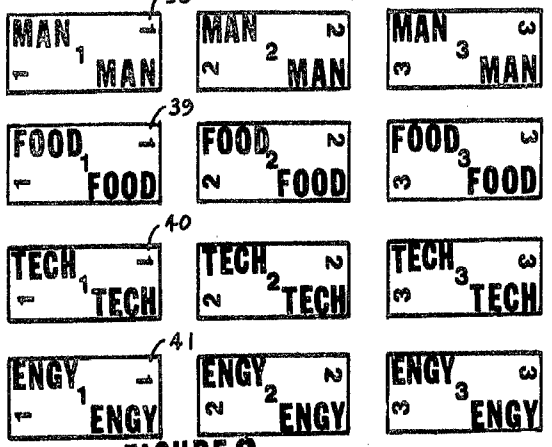
FIG. 2 is a plan view of a plurality of different resource tokens.
Figure 5:
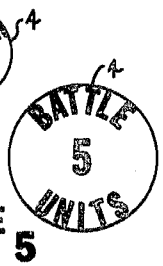
FIG. 5 is a plan view of first and second contest tokens having different denominations.
Figure 7:
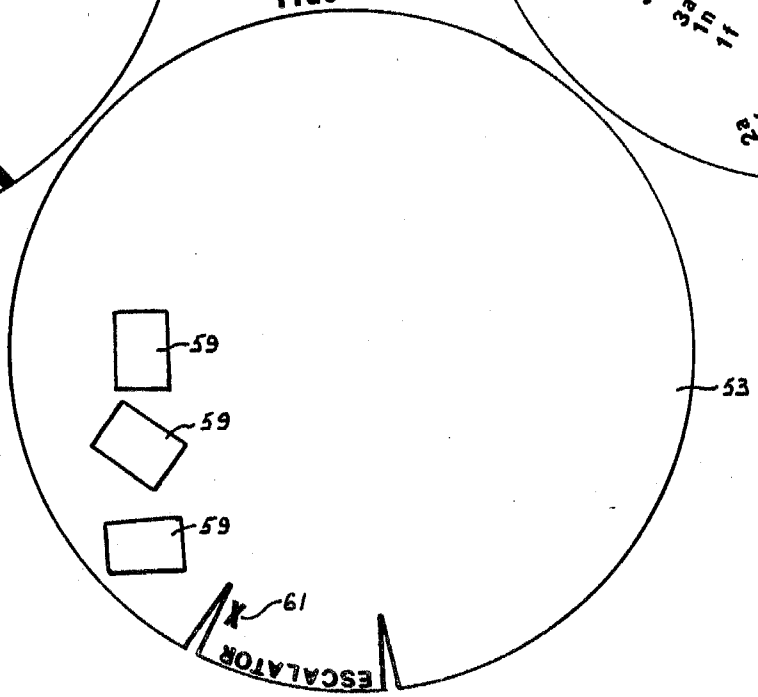
FIG. 7 is a plan view of a second disk member of the battle computer, which underlies the first member, and includes windows therethrough.
Figure 6:
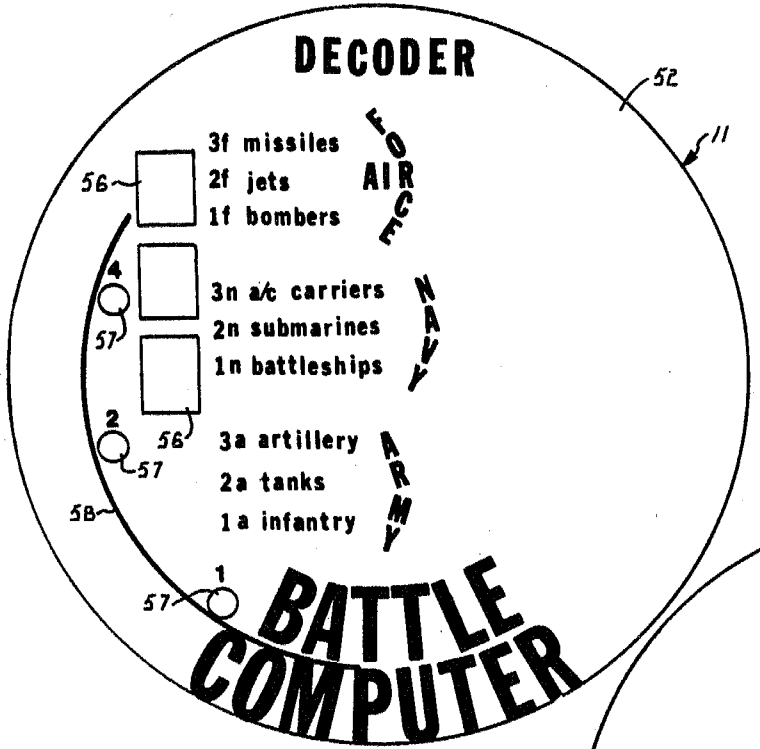
FIG. 6 is a plan view of a first disk member of a battle computer having windows therein, and adapted for determining the right to occupy a cartel challenged by a player.

The reference numeral 1 generally designates a game board having a playing area 2 divided into a plurality of separate regions representing cartels 3. A plurality of battle units or contest tokens 4 (FIG. 5) are movable about the playing area 2 between adjacent cartels 3. A resource calculator 5 (FIGS. 9 and 10) designates at least two resources 6, generates a production index 7 and a consumption index 8 for each of the resources, and provides instruction for exchanging surplus resources, which are tallied with resource tokens 9 (FIG. 2). A container 10 (FIG. 3) is shaped for retaining resources tokens 9 therein, and forms a common market place for exchanging a quantity of one resource for a quantity of another resource. A chance apparatus 11 (FIGS. 6–8) is provided for determining the right to occupy a cartel challenged by a player, whereby in playing the game, each player receives resource tokens 9 in accordance with the assigned production index for each cartel which the player occupies, and must balance production and consumption of each of his resources. Players may withhold selected resources from the market place, and/or exchange surplus resource tokens 9 for contest tokens 4 and challenge opposing players for the right to occupy a cartel, so as to ultimately obtain simultaneous occupation of a preselected, game ending number of the cartels.

In the illustrated game board 1, each of the regions or cartels 3 is spaced apart and separated from adjacent cartels by a space or corridor 14. The playing area 2 has a circular shape, and is divided radially into alternate sections of cartels 3 and corridors 14. Each of the radial sections of the playing area which have cartels therein include at least two cartels which are arcuately shaped and radially spaced apart by an interjacent corridor 14. In this example, the playing board 1 is a geometric representation of the earth, as viewed from a North Polar perspective. The world or playing area 2 has been divided into eight international cartels 3, representing clusters of countries with common geographic, economic and philosophical interests, and twelve corridors 14, representing undeveloped or underdeveloped areas of the earth. The cartels 3 are divided into four major cartels and four minor cartels. The four major cartels are designated: Common Market, Soviet Union, North America and Middle East, 16–19 respectively. The four minor cartels are designated: Orient, South America, South African Coalition (SAC) and Australia, 20–23 respectively. Each of the cartels is separated from every other cartel by at least one corridor, and each cartel has four different corridors adjoining the boundry thereof. The twelve corridors are entitled and marked: Artic Circle, Atlantic Ocean, Slavic Bloc/Indian Ocean, Pacific Ocean, Mediterranean Sea, Mongolia-Manchuria, Panama Canal, Sahara Desert, Indonesia, South Polar Route, Southern Access and Megellan Straits, 24–35 respectively. Each of the cartels 3 and corridors 14 may be provided with a different color to separate the same for easy visual perception of the various areas. The cartels 3 are arranged on the playing area 2 to provide interaction among the players, and the corridors 14 provide buffer zones between the various cartels.

In the illustrated game, there are four designated resources, comprising manpower, food, technology and energy. The resources are preferably appropriately designated as previously noted, so as to simulate the actual resources available to man. The resources are evidenced and tallied by resource tokens or certificates 9, which are provided with indicia to indicate the four different kinds of resources: manpower 38, food 39, technology 40 and energy 41. The resource tokens 9 are provided in denominations of 1, 2 and 3 units, and each token bears indicia designating the resource and denomination. There are four certificates of each denomination for each resource, such that the total member of units for each resource is 24. The resource tokens have side edges which are spaced in a manner to be inserted into the slots 44, and are frictionally retained therein.

The illustrated container 10 for the resource tokens is entitled the "World Bank" and comprises a flat grid 43, with 48 spaced slots 44 therein for receiving the 48 resource certificates. The resource tokens are inserted into the slots 44 and are frictionally retained therein. The slots 44 are preferably arranged in three rows 45 and four columns 46, and include appropriately positioned indicia designating a denomination and a type of resource, so as to conveniently organize the resource tokens.

A first card deck is provided and includes a plurality of disaster cards 49, each of which designates a particular disaster and consequence thereon to present an in-turn player by an opposing player to reduce the production index of one or more selected resources in a manner prescribed by the card. In this example, there are ten disaster cards, and each includes indicia designating a particular type of natural disaster, such as an earthquake, flood, epidemic, drought, or the like, as well as man induced disasters, such as strikes and sabotage. A consequence typically associated with each disaster is noted by indicia on the card. For example, a card designating a flood disaster thereon indicates loss of all food production for the players turn.

A second card deck includes a plurality of secret attack cards 50, each of which designates a path for moving contest tokens between nonadjacently disposed cartels for use by an in-turn player to challenge an opposing player. In the illustrated game, ten secret attack cards are provided, and each indicates that the holder may move from a particular cartel or corridor to a desired cartel or corridor, and further indicating an increased risk for challenging an opposing player for the right to occupy a cartel to which the player moves under the secret attack card, as hereinafter described in detail. The disaster cards 49 and secret attack cards 50 are preferably randomly mixed in a single deck during use, and serve to provide an incentive for competitive interaction between the various players.

The contest tokens 4 (FIG. 5) are preferably provided in multiple denominations, such as one and five, and are color coded to match the color of the major cartel occupied by the holder of the tokens. The illustrated contest tokens bear the marking "battle unit", and are sized so as to be bodily placed in the cartel and corridor regions of a playing area. The game is provided with enough contest tokens, so that the supply thereof will not become exhausted.

Figure 8:
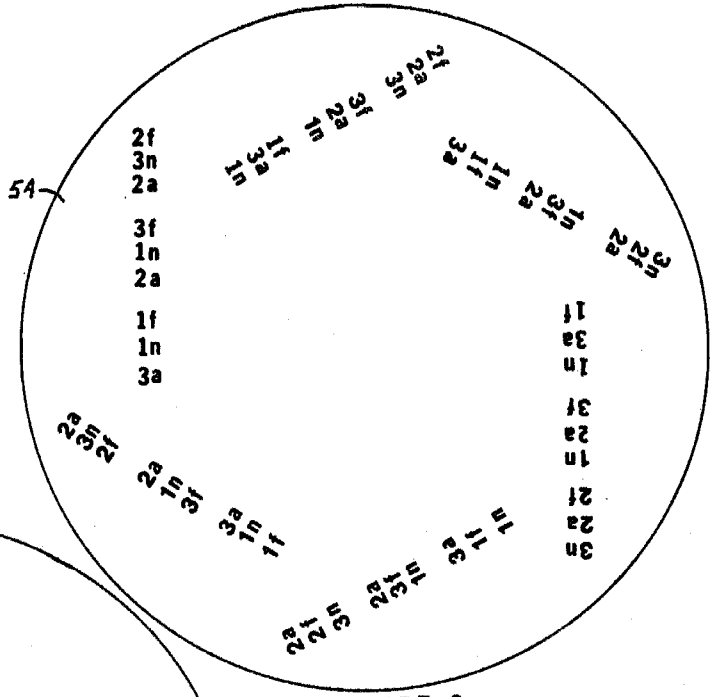
FIG. 8 is a third disk member of the battle computer, which underlies said second disk member and includes indicia thereon which appears through the windows in the first and second disk members.

The illustrated chance apparatus 11 comprises a battle computer consisting of a decoder 52 (FIG. 6), an escalator 53 (FIG. 7), and a tactics wheel 54 (FIG. 8). The decoder 52, escalator 53 and tactics wheel 54 each have a disc shape, are constructed of a sheet material, and are pivotally interconnected at a central axis thereof so as to position each of the discs concentrically. The decoder disc 52 includes three rectangularly shaped windows 56, three circularly shaped windows 57, and an arcuate slot 58. The escalator disc 53 includes three rectangularly shaped windows 59 which are adapted to selectively mate with one of the rectangular decoder windows 56, and a tab marked "escalator" which extends outwardly through the slot 58 and is adapted to be grasped and manipulated by the user. The tab marked "escalator" further includes locater indicia which is positioned thereon for viewing through a selected one of the circular decoder windows 57. The tactics wheel 54 includes six sets of two digit, alphanumeric symbols thereon, wherein each set is arranged into three separate groups of three symbols each. The first digit of each symbol is a letter chosen from the set consisting of f, n, and a, and the second digit is an Arabic numeral selected from the set of numbers consisting of 1, 2 and 3. Each group of symbols is adapted to be viewed through one of the escalator windows 59, and a decoder window 56, and provides chance means for determining the right to occupy a challenged cartel. The decoder disc 52 further includes indicia thereon interpreting and rating the alphanumeric symbols appearing on the tactics card 54. Programming a battle computer consists of choosing an escalator level, such as those marked 1, 2 and 3 on the decoder disc 52 which are positioned adjacent to an associated circular window 57. The player rotates the escalator disc 53 until such time as the locator indicia 61 on the tab marked "escalator" appears through the window associated with the chosen escalation level. The player then rotates the tactics wheel 54, and selects one of the six sets of tactics on that level, and positions the same squarely within the associated rectangular window 56. The escalation level indicates how many battle units a player is waging in the particular battle. The tactics wheel 54 contains 18 sets of tactics, with six sets on each of the escalator level. Each set of tactics includes a weapon from the Air Force, Navy and the Army, and on any particular level contains the same three weapons, with only the order in which they appear being altered. The indicia appearing on the decoder disc 52 interprets each alphanumeric combination appearing on the tactics wheel into a specific weapon and a specific military service.

Figure 10:
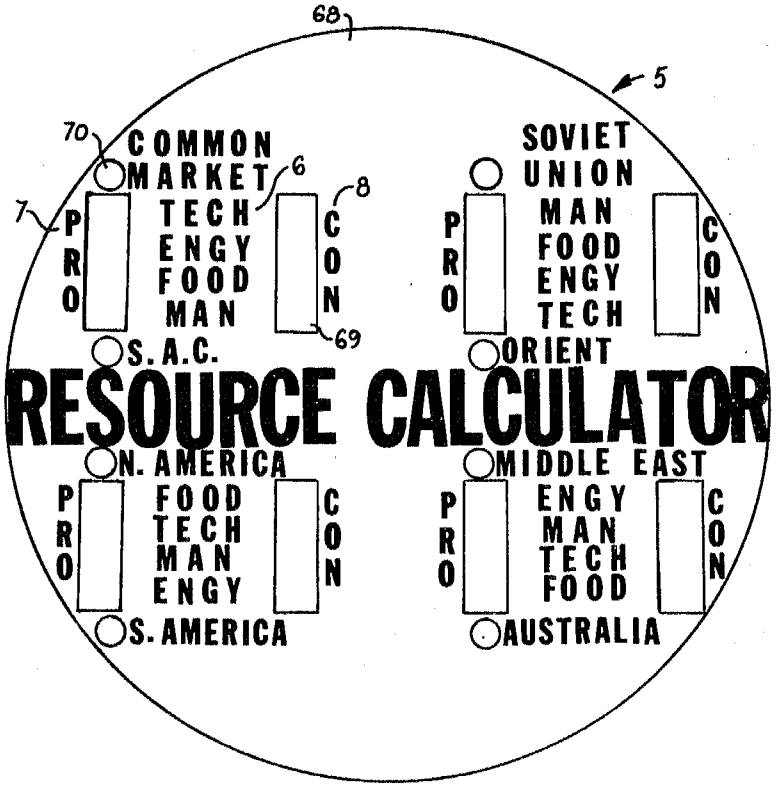
FIG. 10 is an exterior disk member of the resource calculator, having a plurality of windows therein through which the indicia of the interior disk appears.
Figure 9:
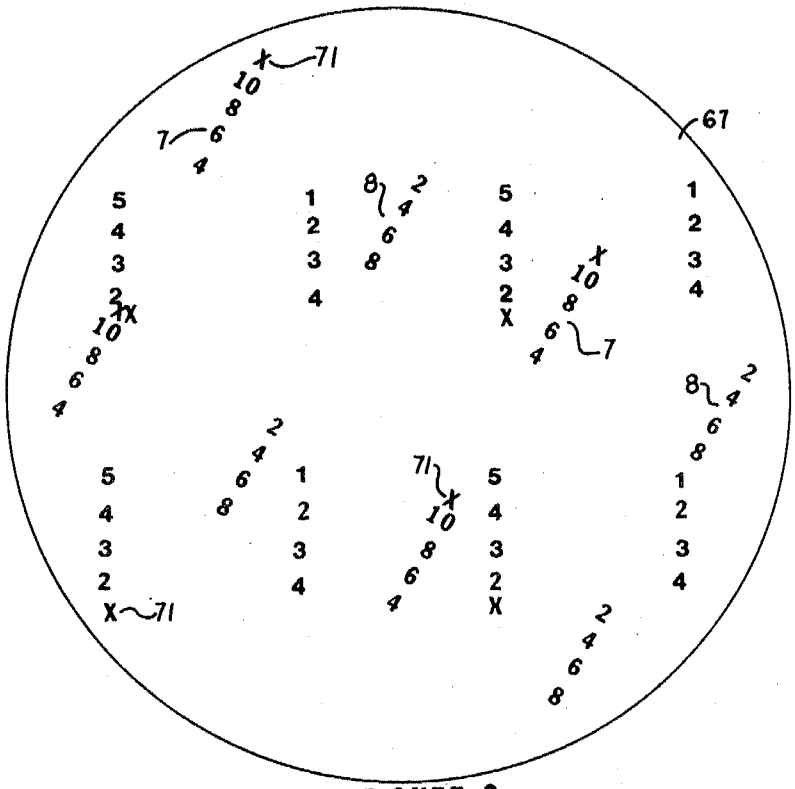
FIG. 9 is an interior disk member of a resource calculator, and includes indicia thereon.

The resource calculator 5 is best illustrated in FIGS. 9 and 10, and comprises a inner disc 67 (FIG. 9), and an outer, overlying disc 68 (FIG. 10). The resource calculator disc 67 and 68 are adapted to be rotatably interconnected about a central axis thereof in a mutually concentric relationship, and for convenience, are preferably connected on the reverse side of the battle computer. The illustrated inner disc 67 includes two sets of whole numbers arranged in eight columns which indicate the production index 7 and an associated consumption index 8. The outer disc 68 includes four pairs of elongate windows 69 which are disposed in a parallel and spaced apart manner and are adapted to align with those numbers representing the production index 7 and the consumption index 8. The outer disc 68 further includes eight circularly shaped windows 70 disposed adjacent to the elongate windows 69, and indicia positioned adjacent thereto and indicating a different cartel. Each group of production and consumption indicies includes a marker indicia 71 adjacent thereto, whereby the production and consumption index of a particular cartel may be determined by rotating the outer disc 68 with respect to the inner disc 67 until the marker indicia 71 appears through the circular window 70 of the selected cartel, and the associated production and consumption appear through the elongate window 69. For each of the major cartels, the production and consumption schedules appear directly below their representative cartel. The resources are listed downwardly between the windows 69. The units of production are listed to the left of each resource and to the right of the letters PRO. The units of consumption are listed to the right of each resource and to the left of the letters "CON". The surplus or deficit of each resource is determined by subtracting the units of consumption from the units of production. In this example, each major cartel therefore has a surplus of 8 units of its top resource and 4 units of its second resource, and a deficit of 4 units for its bottom resource, with the third resource breaking even. To obtain the schedules for the minor cartels, turn inner disc 67 (FIG. 9) until the "X" shows through the holes to the left of the minor cartels. The schedules for each appear directly above their respective minor cartel. The manipulation of the resources of the major cartels as above described applies to the minor cartels' resources, except that the latter have lower production and consumption units, whereby supluses and deficits, are at ½ that of the major cartels. The production and consumption index for the cartels are chosen with a predetermined relationship. The desired relationship among the major cartel is such that for each major cartel, there is another major cartel whose production and consumption indexes are complimentary with the first, such that the primary surplus and deficits are opposite.

Each game is equipped with a playing board 1, a set of resource tokens 9, a World Bank 10, two resource calculators 5, four sets of battle units 4, two battle computers 11, and a deck of secret attack cards 50 and disaster cards 49.

All resource tokens or certificates 9 originate in the World Bank 10. One of the players is selected to initiate play, and preferably the selection is by chance, such as by drawing from resource tokens placed face down on the playing surface. Each player picks one of the resource tokens, with the player choosing the odd denomination going first, and the remaining players following in a clockwise order. Each player chooses in turn a major cartel, and places twenty of his battle units or contest tokens 4 in that cartel on the board. When only three persons are playing, the fourth major cartel is available for occupation and is treated like a minor cartel, except that it has the production and consumption schedules of a major cartel. For three players, it is preferred that six units of each resource be removed from the game. Starting with the player going first, each player in turn receives 8 units of his top resource and 4 units of the second resource. To account for the 4-unit deficit of his bottom resource, he then returns any 4 of the 12 resource units to the World Bank.

Each player completes a series of actions during his turn. The first action that a player must perform is to balance the production and consumption indexes or schedules for each cartel that he occupies, balancing his original major cartel only after all other occupied cartels' schedules have been balanced. It is during this time that any other player may inflict a disaster on one of the in-turn player's cartels, curtailing production of a particular resource for that cartel for the present turn. When balancing the schedules of any cartel, all surpluses are taken first. If the surpluses are available in the World Bank, they may be withdrawn and placed in the player's stockpile. Stockpiling resources is a form of economic embargo, since it removes from play resources which another player may need. If sufficient resources are not available in the World Bank, or if a player prefers, battle units may be substituted for resource surpluses at the rate of one battle unit for any one resource unit. All battle units substituted for resource surpluses are placed in the cartel that produced them. After all surpluses are taken for a cartel, the player must then account for any deficits. The deficit accounting may be accomplished in any one of the following 5 manners:

1. To whatever extent a deficit resource is available in the World Bank, the player may pay into the Bank an equal number of units of any resources. For example, if the Common Market has a deficit of 4 units of manpower, and if there are 4 units of manpower in the Bank, 4 units of any resources may be paid into the Bank by the Common Market from their resource surpluses to satisfy the deficit. If there are only 2 units of manpower in the Bank, 2 units of the deficit resource may be accounted for by any 2 units of resource, and the other 2-unit deficit may be accounted for in any of the remaining ways.
2. The deficit may be paid directly into the World Bank from the player's own stockpile.
3. The player may trade with other players to acquire the needed resource to pay into the World Bank.

4. The player may reallocate resource units of other resources which are in the player's stockpile. Any reallocation causes a net loss, and the extent of this loss is based on the following formula. If the reallocation spans two resources as they appear on the players production-consumption schedules 6 and 7, the ratio is at a 2 for 1 loss. If the reallocation spans three resources, the loss ratio is 3 for 1, and if the reallocation spans all four resources, the loss ratio is 4 for 1. For instance, in the case of the Common Market, 2 units of food, 3 units of energy or 4 units of technology can be reallocated to make up 1 unit of manpower; 2 units of energy or 3 units of technology can make up 1 unit of food; and 2 units of technology can be reallocated for 1 unit of energy. When reallocating a higher resource for a lower one on the schedules, the loss ratio is still 2 for 1, 3 for 1, and 4 for 1, for spanning two, three, and four resources, respectively. All resource reallocations are paid into the World Bank.
5. The player may reconvert battle units located in the cartel requiring balancing to any resource units, at the rate of 3 battle units per 1 resource unit. Reconverted battle units are removed from the board, but are available again for purchase at the rate of 1 battle unit for any 1 resource unit.

If a player can not balance the schedules for a captured cartel using any of the five ways, all battle units within that cartel are lost and the cartel becomes available for occupation. If a player can not balance the indexes or schedules for his original major cartel, then that player is out of the game and all his battle units are removed from the board, all his resource certificates are returned to the World Bank, and all his secret attack cards and disaster cards are placed on the bottom of the deck.

Once a player has balanced all schedules, he has the option of doing any of the following actions. However, the player's moves must be performed in the order set forth below. Once a player has moved, he may not return to an earlier action, as set forth below.

1. The player may buy battle units, at the rate of 1 battle unit for each resource unit. All battle units purchased in this manner are positioned on and originate from the original major cartel of the player, and the resource certificates paid therefor are placed in the World Bank. If a player desires battle units to originate from a captured cartel, battle units must have been substituted for resource certificates when that cartel's schedules were balanced.
2. The player makes all battle unit movements. Any number of battle units may move in any direction from any of the cartels or corridors, as long as no one unit moves more than one cartel or corridor away from its point of departure. The battle units of different players may coexist in a corridor without doing battle, but only one player's battle units may occupy a cartel at any one time. Battle units wishing to attack another's forces in a corridor must be in that corridor to attack there. Battle units attacking a cartel must attack from a corridor adjacent that cartel. Units may move into a corridor and attack within that corridor on the same turn. Forces may not attack a cartel if they were not in an adjacent corridor prior to that turn, since a total military victory would result in battle units moving into that cartel, constituting a move of two spaces away from the point of departure during one turn.
3. All battles take place after a player's movements have been completed, except as noted later for a defensive attack. When battling forces in a cartel, all units in adjacent corridors prior to that turn may be combined in a battle. To do battle, one simply announces an attack, thereby challenging an opposing player to the right to occupy the opposing player's cartel, and each of the players programs a battle computer. Programming a computer consists of choosing one of the escalation levels, 1, 2 or 4 and selecting one of the six sets of tactics for that level. This step is done in secret, and both players may be on different escalation levels, thereby risking different numbers of battle units in the battle. Players on the same escalation level have equal opportunities to win the battle. When players are on successive escalation levels (4 vs. 2 or 2 vs. 1), the odds are 2 to 1 in favor of the higher level winning. When one player is on the 4 level and the other player is on the 1 level, the odds are 4 to 1 in favor of the higher level winning. In other words, the odds for or against winning the battle are in direct proportion to the ratio of battle units which one player is waging against the other. The decoder serves two functions. The first is to translate each numeral-letter combination on the tactics wheel into one of the three weapons of either the air force, the navy or the army. The decoder's second purpose is to rank the weapons with each other. Any weapon listed higher on the decoder defeats any weapon listed below it. This means that one's air force will always defeat an opponent's navy or army, and that one's navy will defeat the other's army. Each set of tactics on the same escalation level contains the same three weapons; only the order in which the three weapons appear changes. When each challenging player has set an escalation level and has chosen a set of tactics, the attacker names the military branch he listed first and the defender responds with the one he listed first. The higher branch of service wins the exchange. If the branches are the same, the higher weapon in that branch wins. The winner of the battle is the player who wins two out of three of the weapons' exchanges. The loser of the challenge removes as many battle units as he waged on his escalator. If neither player wins two out of three exchanges, neither loses any battle units. In selecting a set of tactics then, one is trying to anticipate or guess the order in which his opponent is placing his air force, navy and army, and to place his air force opposite the other's navy and his navy opposite the other's army. If one can guess the other's player's order and chooses his tactics appropriately, he can always defeat the other, regardless of which escalation level either is on. Selecting an escalation level is therefore based on the amount of risk a player wants to take, as well as how confident the player is in outguessing his opponent's tactics. After a battle is completed, the attacker may continue or halt this or any other attack. When a player defeats the last battle unit in a cartel, he must move into the conquered cartel at least as many battle units as he waged on his last battle. He may move as many battle units into that cartel as he had in adjacent corridors prior to that turn. It is during the attack phase of a turn that a player may use a secret attack card. A secret attack may continue throughout a player's turn, as long as the cartels or corridors involved remain the same. For the privilege of making this special attack, the attacker risks twice as many battle units as he waged on his computer. If, during the course of a players turn, the player is able to either defeat a total of at least five battle units from other players, or defeat a player's last battle unit in a cartel or corridor, the player receives a card from the secret attack card and disaster card deck. Only one such card may be earned per turn. These cards may not be traded.

4. The player may purchase more battle units at a 1 to 1 ratio for any resource certificates. All battle units purchased must originate from the original major cartel.

Military embargoes may be announced or withdrawn at any time. There are three kinds of military embargoes:

1. A first type of military embargo occurs when one major cartel is cut off from another major cartel, thereby preventing the two cartels from trading resource certificates with each other. This can be accomplished by having dominant occupation of or controlling all corridors separating the two cartels. Control over a majority of contest tokens in a given corridor by a player constitutes a dominant occupation of that corridor. Hence, to control a corridor, a player simply must have more battle units within that corridor than any other player effected by the embargo. Players may combine forces to control a corridor, or all corridors, needed to enact a military embargo. Players may also combine forces in corridors to prevent a military embargo.
2. A captured cartel can be cut off from the major cartel's stockpile by controlling all corridors separating the two cartels. The result of such a military embargo is that all deficits must be accounted for by captured cartel, without the use of the major cartel's stockpile, and all surpluses must be taken in battle units.
3. Any cartel can be cut off from the World Bank if all four corridors surrounding that cartel are controlled by players enforcing such an embargo. This prevents that cartel from using the World Bank to balance resource deficits, and all surpluses must be taken in battle units.

When an embargo is announced, any player directly effected by it, and who has battle units in an imposing corridor, may immediately declare a defensive attack. If more than one player declares a defensive attack, the player whose turn is next attacks first. The attack may continue or halt at the declarer's discretion. If the player can defeat enough battle units so that no player enforcing the embargo has control of the corridor, the embargo is lifted. The declarer may receive a card from the secret attack/disaster deck if he meets the usual criteria.

A player wins the game by simultaneously occupying any five cartels, after the third round of play. As previously noted, a player is eliminated from the game if he is unable to balance his original major cartel's schedules. If a player is eliminated, all his battle units, resource certificates and secret attack and disaster cards are returned to their respective place of origin. A player is also eliminated from the game if he loses his original major cartel to another's forces, and fails to recapture it immediately after balancing all schedules on his next turn. A player who successfully holds the major cartel after the loser's unsuccessful attempt to recapture it, take possession of all cartels occupied by that player, and the contest token therein are exchanged for the victors own. The victor also takes possession of all of the loser's resource certificates, as well as his secret attack and disaster cards.

It is to be understood that while I have illustrated and described certain forms of my invention, it is not to be limited to the specific forms or arrangement of parts herein described and shown.

What is claimed and desired to secure by Letters Patent is:

1. A game apparatus, comprising:

(a) a game board having a playing area divided into a plurality of separate regions; each of said regions representing a different cartel, and being assigned a separate name;

(b) a plurality of contest tokens associated with each player; said contest tokens are movable about said playing area between adjacent cartels for occupying a cartel, challenging opposing players to the right to occupy a cartel, and for defending such a challenge; said contest tokens being unlimitedly available;

(c) a plurality of battle computers operating cooperatively with said contest tokens for determining outcomes of challenges by opposing players; said battle computers allowing each of said opposing players to preselect the number of contest tokens to be risked in a particular challenge and providing a probability of success for said challenge; said battle computers also allowing each of said opposite players to choose indicia for a particular battle plan without knowledge of the plan chosen by opposing players until the chosen plans of all players are set in said battle computers; said battle computers also including means for comparing the indicia of opposing players and determining an outcome wherein the risked contest tokens of at least one of said opposing players may be removed from the playing area;

(d) a plurality of resource tokens; each of said resource tokens being related to one of a set of at least two different resources; resource tokens for each of the resources being limited in number; each of said resource tokens having a defined cooperative exchange relationship with said contest tokens; said contest tokens being used in the playing area being limited by such an exchange relationship;

(e) means for retaining therein excess resource tokens which are not associated with any cartel and forming among the players a common market place for exchanging a quantity of one resource for a quantity of another resource;

(f) a resource calculator having the name of each cartel noted thereon and designating each of said resources; said resource calculator including:

(1) means generating a fixed production index and a fixed consumption index related to the production index for each resource of each cartel; production and consumption indexes for each cartel being different but interrelated;

(2) means for defining an exchange relationship of surplus resources of one of the cartels and contest tokens;

(3) means establishing an exchange rate for exchanging a quantity of a first resource for a quantity of a second resource where said second resource has been exhausted within one of said cartels; and (g) whereby in playing said game, each player receives resource tokens in accordance with said generating means for each cartel which the player occupies and must balance production and consumption of each resource for each of the cartels occupied by the player, and withholds selected resources from the market place and exchanges surplus resource tokens for contest tokens and challenges opposing players for the right to occupy a cartel, so as to ultimately obtain simultaneous occupation of a preselected, game-ending number of said cartels.

2. A game apparatus as set forth in claim 1 wherein:

(a) each of said regions is spaced apart and separated from adjacent regions by a space, and each space represents a different corridor and is assigned a separate name;

(b) control over a majority of contest tokens in a given corridor by a player constitutes a dominant occupation of said given corridor; and (c) said contest tokens are movable in said corridors, whereby the dominant occupation of each corridor surrounding a cartel of an opposing player forms a military embargo and prevents said opposing player from exchanging resource tokens at said common market place.

3. A game apparatus as set forth in claim 1 including:

(a) a card deck including a plurality of cards each designating a particular disaster and consequence thereon to present to an in-turn player by an opposing player to reduce the production index of a selected resource in a manner prescribed by said card.

4. A game apparatus as set forth in claim 1 including:

(a) a card deck including a plurality of cards each designating a path for moving contest tokens between non-adjacent disposed cartels for use by an in-turn player to challenge an opposing player.

5. A game apparatus as set forth in claim 1 wherein:

(a) each of said regions is spaced apart and separated from adjacent regions by a space; each space represents a different corridor, and is assigned a separate name;

(b) control over a majority of contest tokens in a given corridor by a player constitutes a dominant occupation of said given corridor; and (c) said contest tokens are movable in said corridors, whereby the dominant occupation of each of the corridors separating first and second cartels forms a military embargo, and prevents the players occupying said first and second cartels from exchanging resource tokens.

6. A game apparatus as set forth in claim 1 wherein:

(a) said cartels are grouped into major and minor cartels, wherein the production index for said major cartels is greater than the production index for said minor cartels and produces larger resource surpluses; and (b) each of said players initially occupies a major cartel.

7. A game apparatus as set forth in claim 1 wherein:

(a) said playing area has a circular shape, and is divided radially into alternate sections of cartels and corridors.

8. A game apparatus as set forth in claim 7 wherein:

(a) each of said cartel sections is further divided into at least two arcuately shaped, radially spaced, cartels; each of said cartels being equally spaced from all other cartels by an identical number of corridors; at least two of said cartel sections being unsymetrical.

9. A game apparatus as set forth in claim 1 including:

(a) a card deck having a plurality of cards each designating a particular disaster and consequence thereon to present to an in-turn player by an opposing player to reduce the production index of a selected resource in a manner prescribed by said card;

(b) a card deck including a plurality of cards each designating a path for moving contest tokens between non-adjacent, disposed cartels for use by an in-turn player to challenge an opposing player; wherein (c) each of said regions is spaced apart and separated from adjacent regions by a space; each space represents a different corridor, and is assigned a separate name;

(d) control over a majority of contest tokens in a given corridor by a player constitutes a dominant occupation of said given corridor; and (d) said contest tokens are movable in said corridors, whereby the dominant occupation of each corridor surrounding a cartel of an opposing player forms a military embargo and prevents said opposing player from exchanging resource tokens at said common market place.

10. A game apparatus as set forth in claim 1 wherein:

(a) each of said regions is spaced apart and separated from adjacent regions by a space, and each space represents a different corridor and is assigned a separate name; corridors on each side of a given cartel cooperate to surround the respective cartel.

11. A game apparatus as set forth in claim 10 wherein:

(a) said contest tokens are movable in said corridors;

(b) control over a majority of contest tokens in a given corridor by a player constitutes a dominant occupation of said given corridor; and (c) dominant occupation of each corridor surrounding a cartel forms an embargo whereby an opposing player occupying the surrounded cartel is prevented from exchaning resource tokens with said common marketplace and with other players.

12. A game apparatus as set forth in claim 1, 10 or 11 including:

(a) a first card deck having a plurality of cards each designating a particular disaster and consequence thereon to present to an in-turn player by an opposing player to reduce the production index of a selected resource in a manner prescribed by said card;

(b) a second card deck including a plurality of cards each designating a path for moving contest tokens between non-adjacent cartels for use by an in-turn player to challenge an opposing player; said first and second card decks being interrelated between each other and with the contest tokens, such that any player causing removal of a preselected number of an opposing players contest tokens from said playing area is allowed to select one of said cards of said first or second decks without seeing same prior to selection, all of said cards being utilized at the receiving players discretion to catalyze increased interaction between opposing players.

* * * * *